US006514163B2

(12) United States Patent
Burns

(10) Patent No.: US 6,514,163 B2
(45) Date of Patent: Feb. 4, 2003

(54) BATTING AID

(76) Inventor: Kevan C. Burns, 1801 Dell Dr., Beloit, WI (US) 53511

( * ) Notice: Subject to any disclaimer, the term of this patent is extended or adjusted under 35 U.S.C. 154(b) by 0 days.

(21) Appl. No.: 09/897,227

(22) Filed: Jul. 2, 2001

(65) Prior Publication Data

US 2003/0004018 A1 Jan. 2, 2003

(51) Int. Cl.[7] ..... A63B 69/00
(52) U.S. Cl. ..... 473/458; 473/422
(58) Field of Search ..... 473/458, 438, 473/412, 414, 215, 213

(56) References Cited

U.S. PATENT DOCUMENTS 1,636,101 A * 7/1927 McLallen ..... 128/878
2,022,910 A * 12/1935 Hanley ..... 473/214
2,650,590 A * 9/1953 Moore et al. ..... 128/882
3,069,169 A * 12/1962 Topping ..... 473/212
3,238,939 A * 3/1966 Stubbs ..... 602/64
5,064,198 A * 11/1991 Szabo ..... 473/213
5,538,501 A * 7/1996 Caswell ..... 602/64
5,704,856 A * 1/1998 Morse ..... 473/422
5,938,548 A 8/1999 Upshaw

* cited by examiner

*Primary Examiner*—Paul T. Sewell
*Assistant Examiner*—M. Chambers

(57) ABSTRACT

A batting aid which is designed to improve a baseball player's batting swing and to strengthen his leading batting arm comprises an upper arm cuff attached to the upper portion of the leading arm of a person preparing to swing a bat, a wrist cuff attached to the wrist of the batter's arm, and an elastic strap connecting them. The wrist cuff has a thumb strap to hold the wrist cuff in place. The wrist cuff and the upper arm cuff are connected by an elastic strap such that, when the batter's leading arm is flexed the elastic strap is slack, and when the arm is extended, the elastic strap becomes taught and provides a resisting force against the further extension of the leading arm.

1 Claim, 2 Drawing Sheets

BATTING AID

This invention relates to a batting aid for use in hitting a baseball, and more particularly to strengthening and positioning the leading arm of a batter while swinging at a baseball.

BACKGROUND OF THE INVENTION

One of the factors that may prevent a batter from consistently hitting a baseball with power is the inadvertent extension of the leading arm during the initial-to-mid portions of a batter's swing at a baseball. When the leading arm is extended, the twisting force of the body is not fully transmitted to the bat because of the long moment-arm created by the extension, and the triceps muscle becomes flexed to nearly the full flexion available to that muscle. The degree of flexion of the triceps muscle is directly proportional to the amount of extension of the leading arm.

A great deal of the power generated in swinging a bat is based upon the batter's leading arm being able to whip the bat across the front of the batter's body at great speed while the upper torso is twisting in the direction of the swing. This, in turn, requires the triceps muscle of the leading arm to provide maximum flexing power and speed at the time the bat is beginning to pass in front of the batter's body. However, if the leading arm is prematurely extended, the full power of the triceps muscle will not be available to pull the bat across the body at maximum speed just when the baseball is striking the bat. As a result, the bat not only hits the ball with less speed, but may also recoil upon striking the ball, making for a poor follow through.

Various prior art devices have been used in an attempt to improve a batter's swing. U.S. Pat. No. 5,938,548 to Upshaw provides a flexible strap with arm cuffs at either end that are intended to limit the distance between a batter's arms during a batting swing. While this device does serve to keep the arms relatively close to one another, it does nothing to overcome a batter's tendency to prematurely extend his or her leading arm when swinging a bat.

U.S. Pat. No. 5,704,856 to Morse uses an elastic strap secured at one end just below the knee of the batter's leading leg, and at the other end to the batter's wrist, to coordinate and synchronize the batter's stepping into a pitch with the swinging of the leading arm. Again, however, this device does nothing to prevent the premature extension of the leading arm while swinging a bat.

What is needed is a device that keeps the leading arm from prematurely extending during a swing, and that simultaneously builds the strength of the triceps muscle to promote a faster bat speed just before the bat contacts the baseball.

SUMMARY OF THE INVENTION

The present invention uses an elastic strap to hold the wrist of the leading arm close to the body during the initial phases of a batting swing, and to strengthen the triceps muscle so that it can develop the greatest power just at the time the bat is striking the ball. The elastic strap is connected at one end to the leading arm toward the upper portion of the biceps muscle and at the other end to the wrist of the leading arm. The strap is secured at the biceps muscle with a soft fabric upper arm cuff that may have a slight amount of elasticity. A rigid, molded "U"-shaped elongated support cup maybe used at the upper arm beneath the upper arm cuff to distribute the force of the elastic strap along the upper portion of the arm. A support strip may also extend from the wrist cuff at the front of the hand, across the hand and between the thumb and forefinger, to reconnect with the wrist cuff at the back of the hand. This support strip will prevent the wrist cuff from riding up the arm from its proper position on the wrist.

In practice, at the beginning of the swing, the elastic strap will tend to hold the wrist close to the upper arm, with the result that the elbow is highly flexed and the triceps muscle is substantially extended. As the swing progresses across the front of the body, the elastic strap will tend to maintain the wrist close to the body, although the elasticity of the strap will allow the triceps muscle to flex as the bat moves across the body, pulling the bat across the front of the body with great speed. In addition, the upper body will twist toward the direction from which the baseball is coming, and will add to the speed of the bat just before it contacts the ball. Because the elastic strap holds the wrist close to the upper arm and body, the batter's swing will be more compact than if the leading arm was extended. In this position, the twisting motion of the upper torso will cause the bat to hit the ball with greater speed and force than if the leading arm had been prematurely extended. In addition to improving a batter's swing in this fashion, the elastic strap also provides a force against the flexion of the triceps muscle, thereby exercising that muscle and, over time, increasing its strength.

Accordingly, it is an object of this invention to improve the technique of a batter's swing. It is another object of the invention to provide greater speed and power to a bat just before the bat strikes a baseball. It is a further object of this invention to exercise and strengthen the triceps muscle of the batter's leading arm. These, and other benefits of the invention, will become apparent in the following description of the drawings.

DETAILED DESCRIPTION OF THE DRAWINGS

Figure 1:
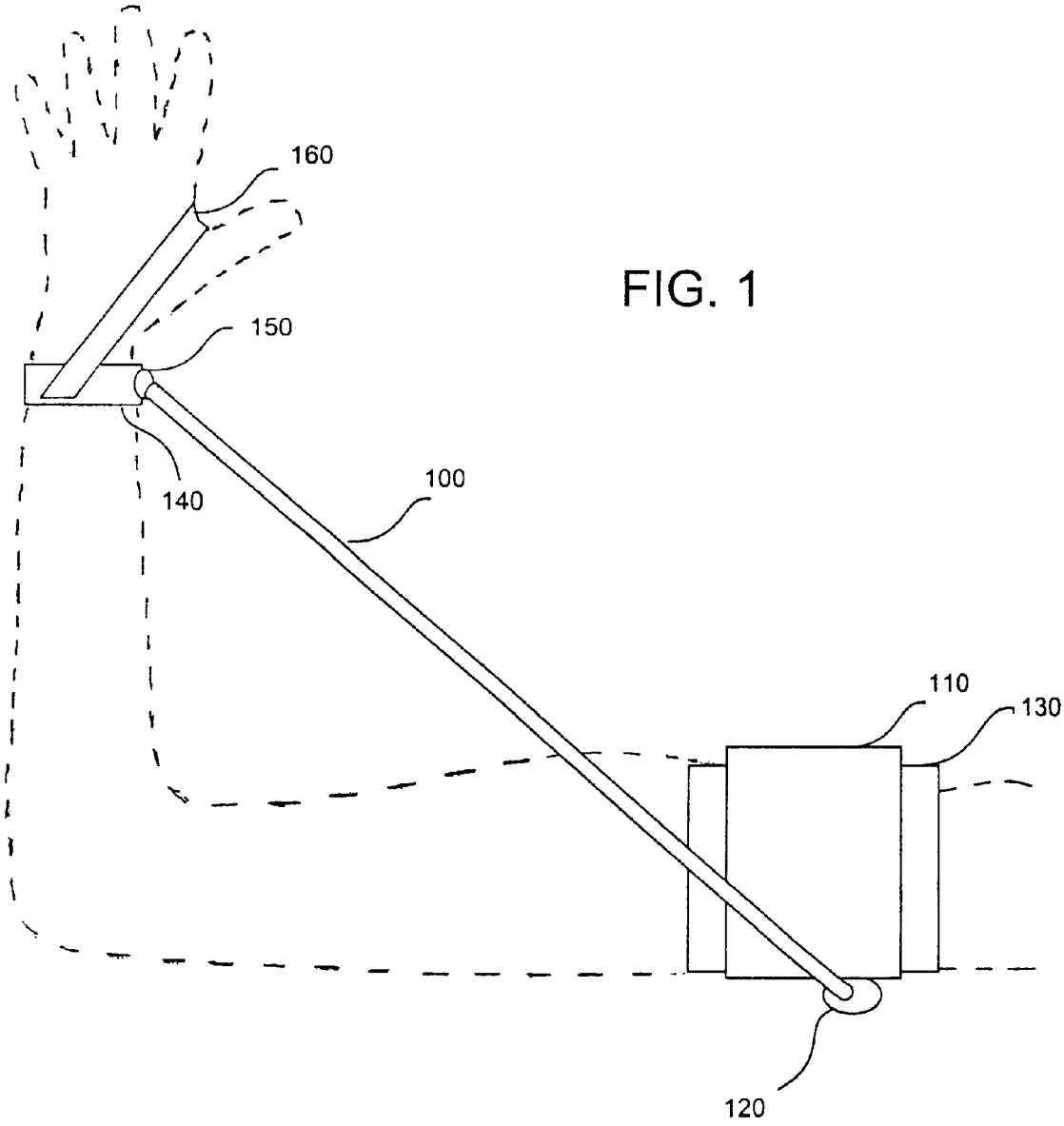
FIG. 1 depicts the apparatus of this invention as attached to the leading arm and wrist of a batter.

In FIG. 1, the apparatus of this invention is shown as attached to the upper arm and wrist of a batter's leading arm. An elastic connector 100, that may be made of surgical rubber, a synthetic elastomer, some other suitable material, or a combination, attaches upper arm band 110 to wrist band 140. Upper arm band 110 fits snugly about the upper arm. A rigid, molded elongated "U" shaped support cup 130 is beneath upper arm band 110, and diffuses and distributes the force exerted by elastic connector 110 across the back of the upper arm. Upper arm band 110 and wrist band 140 are adjustable and may be fastened to themselves with velcro or any other suitable fastening means. They may also have elasticity to keep them snug around the wrist or upper arm. An oval or "D" shaped ring 120 is attached to upper arm band 110 by conventional means such as sewing or riveting, as is oval or "D" ring 150 attached to wrist band 140. Although a single "D" ring is shown, various configurations may employ two "D" Rings to provide for better positioning of the elastic connector or to provide a sturdier construction. A thumb support strap 160 holds wrist band 140 from sliding toward the elbow, and may be permanently attached to wrist band 140 or may be adjustably fastened using velcro, snaps, buttons, or other suitable fastening means. Elastic connector 100 preferably is threaded through links 120 and 150, and forms generally a loop, or double strand configuration, thereby providing a greater resistance to stretching and less wear and tear through constant use than would a single strand.

In batting practice, elastic connector 100 will normally be slack when a batter is awaiting a pitch or is otherwise preparing to swing. The double-strand elastic connector will extend to either side of the batter's upper arm, and, while normally slack when the arm is flexed, will provide a force that resists the extension of the batter's leading arm. As the batter commences his or her swing, if he or she should begin to prematurely extend the leading arm, elastic connector 100 will tighten and present resistance to the wrist of the leading arm moving away from the upper arm band 110, thereby reminding the batter that premature extension of the leading arm is to be avoided. After a number of batting sessions with the apparatus of this invention, a batter will "remember" the correction provided by the apparatus, and his or her swing will naturally improve.

Figure 2:
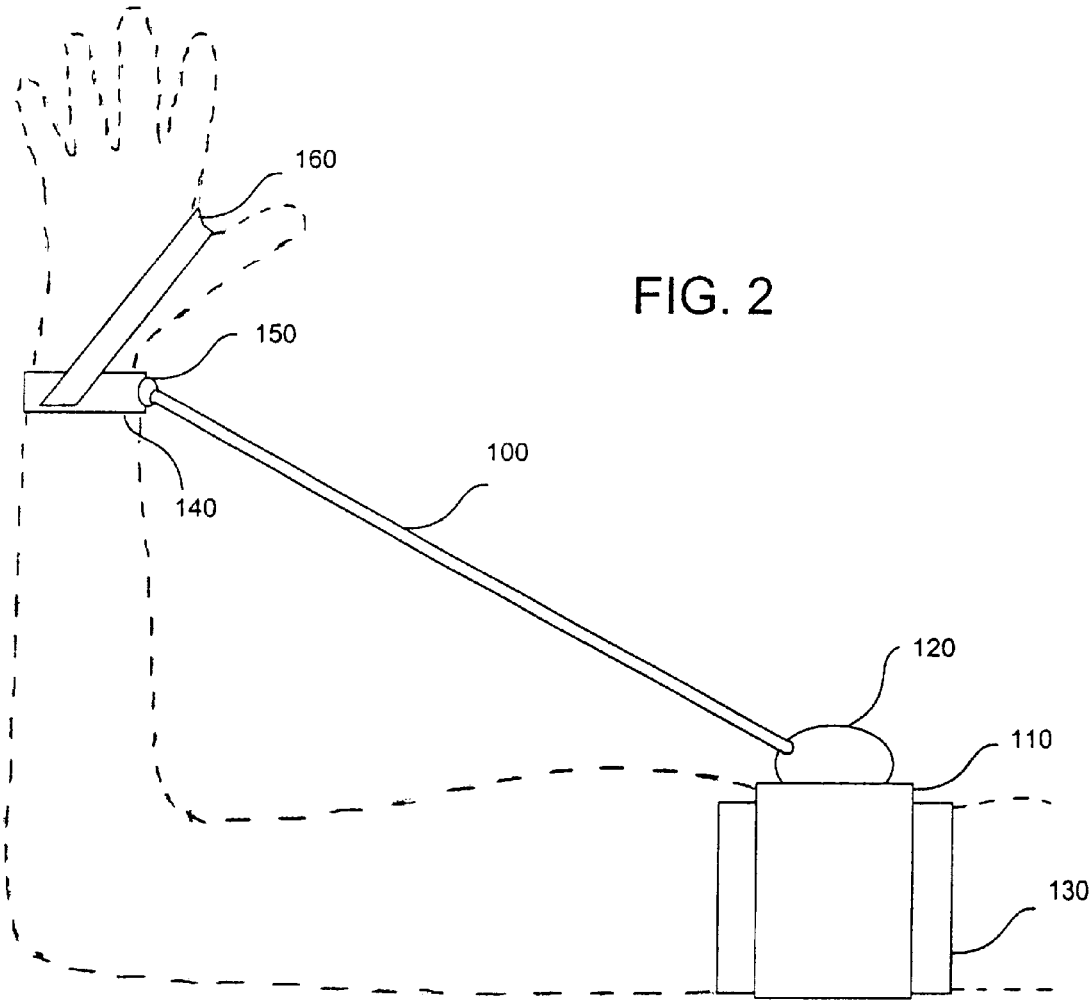
FIG. 2 depicts an alternative embodiment of the apparatus of this invention.

FIG. 2 depicts an alternative embodiment for the apparatus of this invention. In FIG. 2, upper arm "D" ring 120 is shown at the front (or top) of the upper arm. In this configuration, there will be slightly less resistance to the initial extension of the batter's leading arm. The elastic connector 100 of FIG. 2 may consist of either a single strand or of many strands.

The apparatus may also be used as a standard exercising device simply to strengthen the triceps muscle without the need to swing a bat. Because it is susceptible of such dual use, and also because different users have different arm strengths, the fact that the elastic connector can be easily exchanged or replaced by an elastic connector of greater or lesser stretch resistance makes this apparatus suitable for a wide variety of users.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A batting aid apparatus for baseball players comprising:

an adjustable upper arm cuff and an adjustable wrist cuff, said upper arm cuff being attached to the upper portion of the leading arm of a person preparing to swing a bat and having fastening means such that the tightness of said upper arm cuff about said upper portion of said arm may be adjusted, said wrist cuff being attached to the wrist portion of said arm and having fastening means such that the tightness of said wrist cuff about said wrist may be adjusted, said wrist cuff being supported against substantial movement away from the hand of said person by an adjustable thumb strap, said thumb strap having a first attachment point to said wrist cuff on one side of said wrist and extending through a space between the thumb and the index finger of said hand, and having a second attachment point to said wrist cuff at a position substantially opposite to said first attachment point, said wrist cuff further comprising a wrist ring attached to said wrist cuff, said upper arm cuff further comprising an upper arm ring located at the portion of said upper arm cuff that is substantially opposite the portion of said upper arm cuff that is closest to said wrist ring, said wrist ring and said upper arm ring being connected by not fewer than two strands of a plurality of elastic strands in which one strand of said not less than two strands of said plurality of elastic strands passes around said upper arm on the outside of said upper arm and a second strand of said not less than two strands of said plurality of elastic strands passes around said upper arm on the inside of said upper arm such that, when said leading arm is flexed said elastic strap is slack, and upon the extension of said leading arm, said plurality of elastic strands become tensioned and provide a resisting force against the further extension of said leading arm.

* * * * *